US006476310B1

(12) United States Patent
Baum et al.

(10) Patent No.: US 6,476,310 B1
(45) Date of Patent: Nov. 5, 2002

(54) MUSICAL WIND INSTRUMENT AND METHOD FOR CONTROLLING SUCH AN INSTRUMENT

(76) Inventors: Ron Baum, 25/4 Yaakov Tzur Street, Givat Massua, Jerusalem (IL); Mordechai Vizel, 164/1 Rachmilevitch Street, Pisgat Zeev, Jerusalem (IL)

( * ) Notice: Subject to any disclaimer, the term of this patent is extended or adjusted under 35 U.S.C. 154(b) by 0 days.

(21) Appl. No.: 09/874,248

(22) Filed: Jun. 6, 2001

(51) Int. Cl.[7] ..... G10H 1/06
(52) U.S. Cl. ..... 84/735; 84/723; 84/600
(58) Field of Search ..... 84/600, 701, 711, 84/723, 725, 729–730, 732, 735, 741, 93

(56) References Cited

U.S. PATENT DOCUMENTS 4,085,646 A 4/1978 Naumann
4,527,456 A 7/1985 Perkins et al.
5,069,107 A * 12/1991 Sakashita ..... 84/735
5,149,904 A * 9/1992 Kamiya et al. ..... 84/723
5,170,003 A 12/1992 Kawashima
5,300,729 A * 4/1994 Tokunaga et al. ..... 84/735

OTHER PUBLICATIONS

Honeywell Catalogue—model DC 010NDC4.

* cited by examiner

*Primary Examiner*—Marlon T. Fletcher
(74) *Attorney, Agent, or Firm*—Mark M. Friedman

(57) ABSTRACT

A musical wind instrument includes a mouthpiece through which the user blows air and a sensor is deployed to produce an output which varies as a function of how hard the user blows through the mouthpiece. A tone generator system is responsive to the sensor output to generate an audible tone wherein a pitch of the audible tone varies as a function of the sensor output, and hence as a function of how hard the user blows.

22 Claims, 9 Drawing Sheets

Block diagram –Electronic application

Block diagram –Electronic application

Block diagram – CPU application

MUSICAL WIND INSTRUMENT AND METHOD FOR CONTROLLING SUCH AN INSTRUMENT

FIELD AND BACKGROUND OF THE INVENTION

The present invention relates to musical instruments and, in particular, it concerns a wind instrument in which a pitch generated is varied in response to how hard a user blows.

It is known to provide electric wind instruments. Such instruments are often electric versions of corresponding acoustic instruments, where the pitch produced is defined primarily by fingering patterns or the position of a slide. A pressure transducer is sometimes used in instruments to provide a volume control, the volume being increased when the user blows harder. Such instruments require a great degree of skill to achieve a desired sequence of pitches corresponding to a desired melody.

In an attempt to make a musical instrument which is more intuitive to use, and which requires a much lower degree of skill and practice, U.S. Pat. No. 4,085,646 to Naumann, discloses an electronic musical instrument which simulates the operation of whistling. The breath pressure is used to define volume while pitch is defined by a measure of a mouth cavity size.

Although the Naumann device would apparently be intuitive to use without any special training, it suffers from serious limitations. Most notably, measurement of the mouth cavity size requires insertion of a sensor system within the mouth. This presents considerable practical complications and renders the device inconvenient and uncomfortable to use.

There is therefore a need for a musical wind instrument which would be intuitive to control, without requiring complex fingering patterns, but which would not require measurement of parameters within the mouth of the user. It would also be highly advantageous to provide a corresponding method for operating a musical wind instrument.

SUMMARY OF THE INVENTION

The present invention is a musical wind instrument and method for controlling such an instrument.

According to the teachings of the present invention there is provided, a musical wind instrument operable by a user to produce a sound, the instrument comprising: (a) a mouthpiece through which the user blows air; (b) a sensor associated with the mouthpiece and deployed to produce an output which varies as a function of how hard the user blows through the mouthpiece; and (c) a tone generator system electrically connected to the sensor and responsive to the output to generate an audible tone wherein a pitch of the audible tone varies as a function of the output, and hence as a function of how hard the user blows.

According to a further feature of the present invention, the mouthpiece is associated with a housing which defines an internal volume such that the user blows through the mouthpiece into the internal volume.

According to a further feature of the present invention, the housing further includes an outlet allowing restricted release of the air from the internal volume.

According to a further feature of the present invention, the outlet is implemented as a manually adjustable valve, the valve being openable to a fully open position to facilitate draining of condensed moisture from the internal volume.

According to a further feature of the present invention, the sensor is a pressure sensor deployed to produce an output which varies as a function of the air pressure within the internal volume.

According to a further feature of the present invention, the pressure sensor is a differential pressure sensor deployed to produce an output which varies as a function of the air pressure within the internal volume relative to ambient pressure.

According to a further feature of the present invention, a flexible membrane is deployed so as to prevent penetration of moisture from the internal volume to the pressure sensor.

According to a further feature of the present invention, the sensor is an air flow sensor.

According to a further feature of the present invention, the tone generator system varies the pitch as a substantially continuous function of the output.

According to a further feature of the present invention, the tone generator system varies the pitch between a number of discrete values corresponding to a predefined scale.

According to a further feature of the present invention, the tone generator system is configured to interrupt generation of the audible tone when the output falls below a predefined threshold value.

According to a further feature of the present invention, there is also provided a volume control associated with the tone generator system and operative to vary a volume of the audible tone.

According to a further feature of the present invention, there is also provided a pitch shift control associated with the tone generator system and operative to shift at least a lower limit of a range of frequencies within which the pitch varies.

According to a further feature of the present invention, there is also provided a sensitivity adjustment control associated with the tone generator system and operative to vary a breadth of a range of frequencies within which the pitch varies.

According to a further feature of the present invention, the tone generator system is implemented using analogue circuitry.

According to a further feature of the present invention, the tone generator system is implemented using a digital computer including a sound ystem, the sensor being connected to the digital computer via an analogue-to-digital converter.

There is also provided according to the teachings of the present invention, a method for controlling a musical wind instrument operated by blowing of a user, the method comprising: (a) measuring a parameter which varies as a continuous function of how hard the user blows; (b) converting the parameter according to a predefined relation into a corresponding frequency; and (c) generating an audible tone having a pitch equal to the corresponding frequency.

According to a further feature of the present invention, the parameter is an air pressure within a volume into which the user blows.

According to a further feature of the present invention, the parameter is a measure of air flow resulting from blowing of the user.

According to a further feature of the present invention, the predefined relation corresponds to a substantially continuous variation of frequency as a function of the parameter.

According to a further feature of the present invention, the predefined relation generates exclusively a number of discrete values of frequency corresponding to a predefined scale.

According to a further feature of the present invention, generation of the audible tone is interrupted when the parameter falls below a predefined threshold value.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a musical wind instrument and method for controlling such an instrument.

The principles and operation of musical instruments according to the present invention may be better understood with reference to the drawings and the accompanying description.

Figure 1:
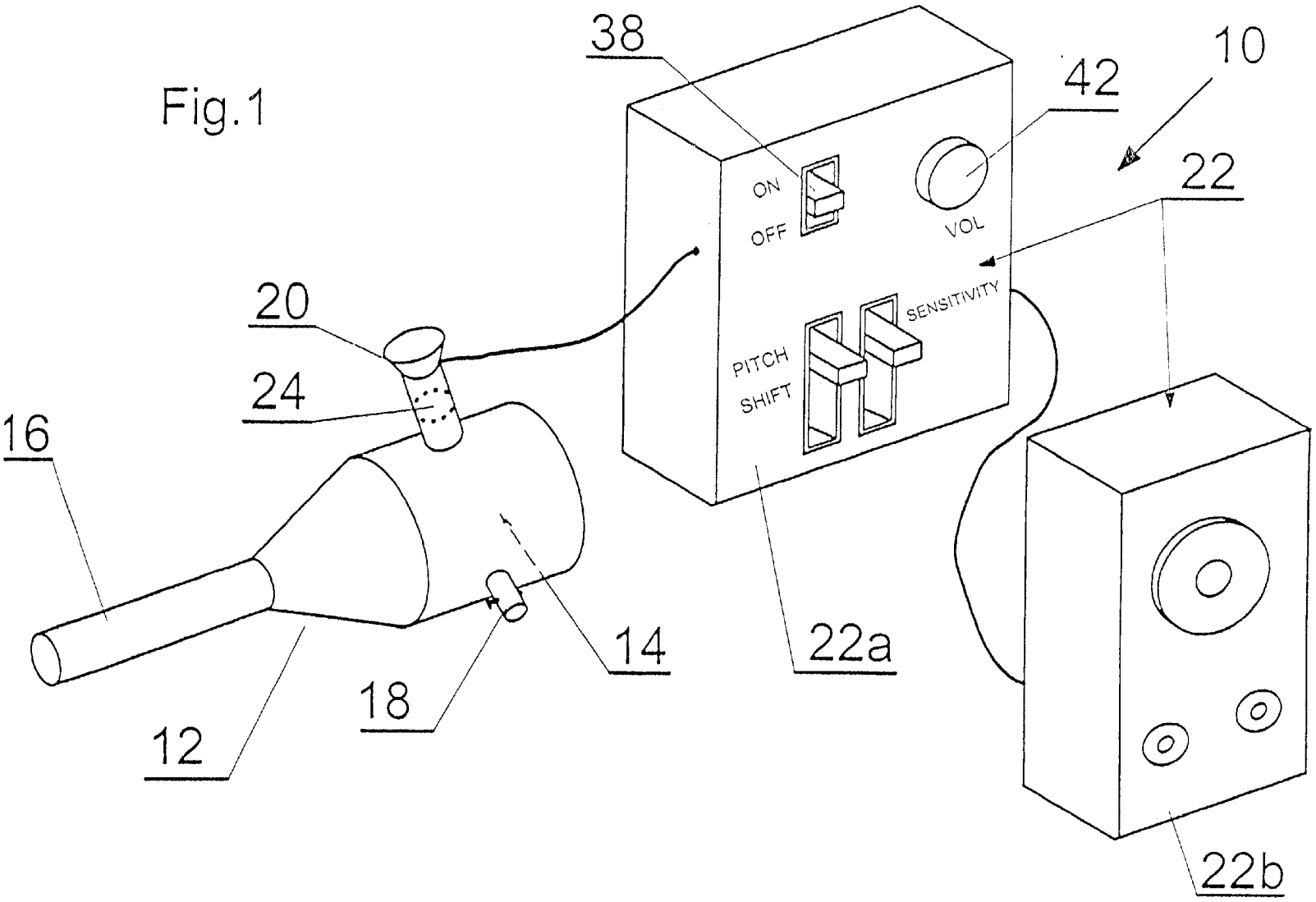
FIG. 1 is a schematic representation of a musical wind instrument, constructed and operative according to the teachings of the present invention.

Referring now to the drawings, FIG. 1 shows a musical wind instrument, generally designated 10, which is operable by a user to produce a sound. Generally speaking, instrument 10 includes a mouthpiece 16 through which the user blows air and a sensor 20 deployed to produce an output which varies as a function of how hard the user blows through mouthpiece 16. A tone generator system 22, electrically connected to sensor 20, is responsive to the output to generate an audible tone. The pitch of the audible tone varies as a function of the output of sensor 20, and hence as a function of how hard the user blows.

Preferably, mouthpiece 16 is associated with a housing 12 which defines an internal volume 14 into which the user blows. Housing 12 preferably also features an outlet 18 allowing restricted release of the air from internal volume 14.

It will be immediately appreciated that the present invention provides a structurally simple and easy-to-use musical wind instrument for which the user does not require any great skill or prior experience. After a short period of experimentation, the user learns to control his or her breath to achieve the required pitch. The user is then readily able to play unlimited tunes and melodies intuitively by ear, just as they could be sung. At the same time, intrusive sensors such as the mouth cavity volume sensor of the aforementioned Naumann reference are avoided. This and other advantages of the present invention will become clearer from the following description.

Before turning to the features of the present invention in more detail, it will be helpful to define certain terminology used herein in the description and claims. Specifically, sensor 20 is described herein as being "deployed to produce an output which varies as a function of how hard the user blows through mouthpiece 16". It should be noted that the term "blow" is used herein to refer to the action which, in the absence of obstruction, would result in exhalation of air by the user. The term as used herein does not necessarily imply that actual movement of air takes place. Thus in one implementation, for example, the user blows through the mouthpiece into a closed container such that no measurable air flow results. In such a case, blowing harder or less hard expresses itself as variations in the pressure of air within the internal volume. At the other extreme, in the absence of significant flow impedance, pressure variations may be small to negligible. In this case, blowing harder or less hard expresses itself primarily as variations in the rate of air flow. Both of these possibilities, and the continuum therebetween, are included within the scope of the terminology "a function of how hard the user blows" as used herein.

Turning now to the features of instrument 10 in more detail, it will be noted that sensor 20 may be implemented as any of a range of sensors which generate an output which varies according to how hard the user blows. Examples of suitable sensors include, but are not limited to, air pressure sensors, airflow speed sensors and volumetric airflow sensors. In one set of preferred cases illustrated herein, sensor 20 is implemented as a pressure sensor deployed to produce an output which varies as a function of the air pressure within internal volume 14. Most preferably, a differential pressure sensor is used so as to measure the internal air pressure relative to ambient pressure. This ensures that operation of the device is unaffected by variations in the ambient conditions under which it is used. The sensor should be chosen to be sensitive within the range of pressures which can comfortably be maintained by a user intermittently over a considerable period of time. A typical operative range is about 1–25 millebar. An example of a suitable sensor is commercially available from Honeywell (MA) as item no. DC010NDC4.

In certain cases, sensor 20 may be susceptible to damage or malfunction if exposed to constant excess moisture. To allow use of such moisture sensitive sensors, a flexible membrane 24 is preferably deployed so as to prevent penetration of moisture from internal volume 14 to sensor 20. Membrane 24 is preferably implemented so as to be sufficiently loose and flexible to have negligible affect upon the pressure measured by sensor 20.

In a simplest embodiment (not shown), the present invention can be implemented by providing an exposed pressure sensor, i.e., not enclosed within a housing, to be positioned in front of the user's mouth to measure the effect of blowing directly. In some cases, such an arrangement may be overly sensitive to minor variations in breath pressure such that it becomes difficult to control accurately. This sensitivity may be reduced by suitable signal processing to smooth out transient pressure variations.

In certain preferred embodiments such as is shown here, sensor 20 is deployed to measure the pressure within internal volume 14 of housing 12 which varies according to the difference between the amount of air blown by the user through mouthpiece 16 and the amount released through outlet 18. This provides an inherent damping effect through which the instrument becomes less sensitive and easier to control. The extent of this damping effect varies according to the size of internal volume 14 and may be chosen to provide a desired balance between responsiveness and over-sensitivity. Optionally, an adjustable plunger (not shown) may be provided to allow manual adjustment of the damping effect by the user.

As mentioned earlier, in an alternative set of embodiments, sensor 20 may be implemented as an air flow sensor. In this case, the sensor is typically deployed "in-line" to measure volumetric flow through part, or the entirety, of housing 12. A range of different types of flow sensors are suited for such an application. By way of one particular non-limiting example, a suitable sensor is commercially available from Honeywell Inc. (Illinois, U.S.) as the AWM 1000 series microbridge mass airflow sensor.

As mentioned earlier, the present invention does not necessarily require that air flow results from the user's blowing. Thus, in the case of a pressure sensor, housing 12 may optionally be implemented without any outlet. More preferably, an outlet 18 provides restricted release of air from internal volume 14. Optimally, outlet 18 should provide sufficient flow impedance to allow the user to maintain his highest desired breath pressure for at least a few seconds without running out of breath. On the other hand, the flow impedance should not be overly high so as to avoid the unnecessary stress caused by prolonged pressure at low flow rates. Typically, a suitable flow impedance is offered by an aperture of between 1 $mm^2$ and 20 $mm^2$, and most preferably 4–10 $mm^2$. Clearly, outlet structures other than a single aperture may equally be used so long as they offer equivalent or similar flow impedance characteristics.

In the preferred embodiment illustrated here, outlet 18 is implemented as a manually adjustable valve which is openable to a fully open position, i.e., a position in which the flow impedance is significantly less than that described previously, to facilitate draining of condensed moisture from internal volume 14. A convenient implementation for such a valve is in the form of a tap in which the "closed" position is adapted to provide a residual opening which has the required flow impedance. This provides a convenient solution to the common problem of accumulation of moisture from a user's breath within wind instruments.

Figure 2:
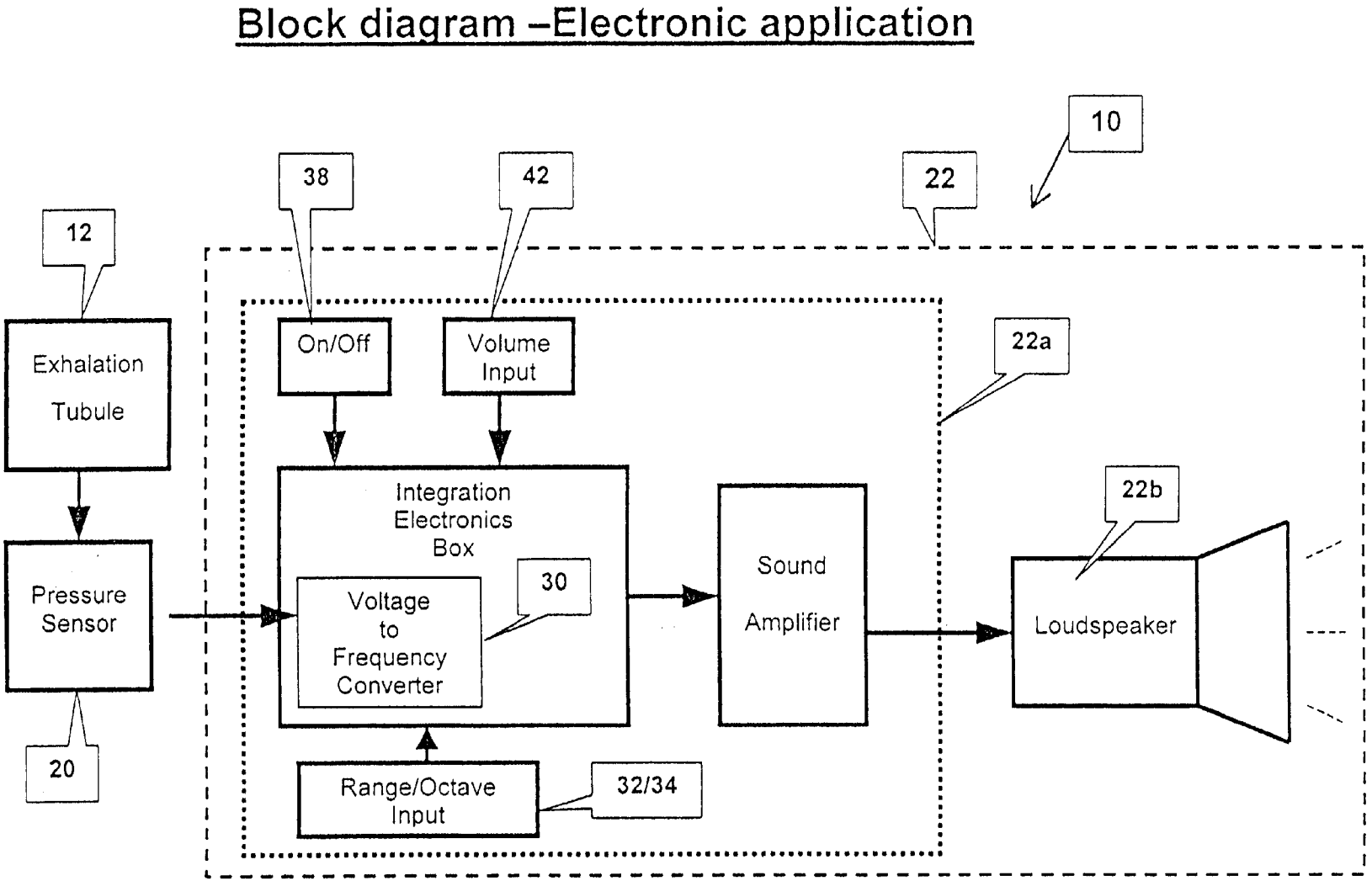
FIG. 2 is a block diagram of a first implementation of the musical instrument of FIG. 1, using analogue circuitry.
Figure 3A:
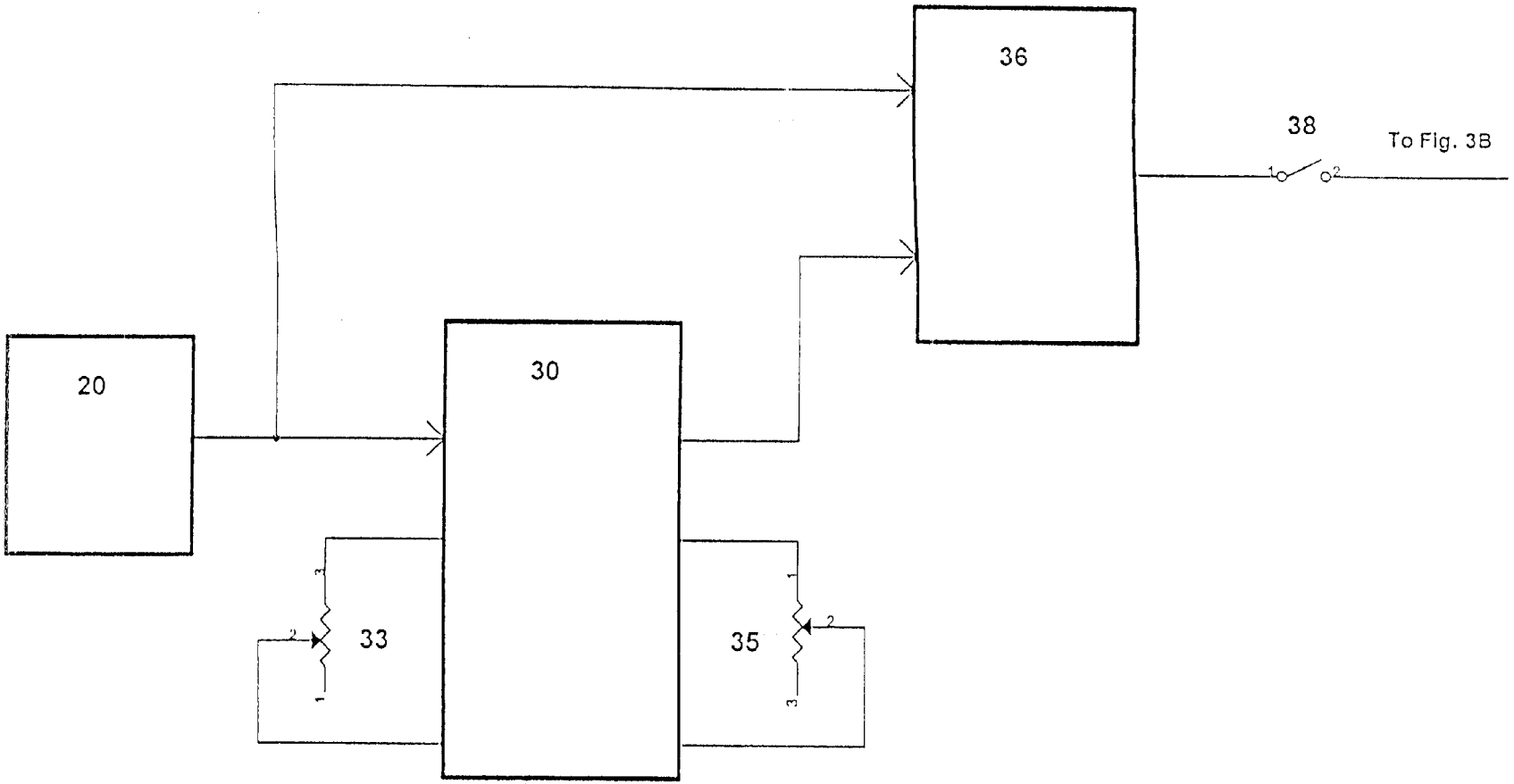
FIGS. 3A and 3B are two parts of a circuit diagram for one possible implementation of the musical instrument of FIG. 1.
Figure 3B:
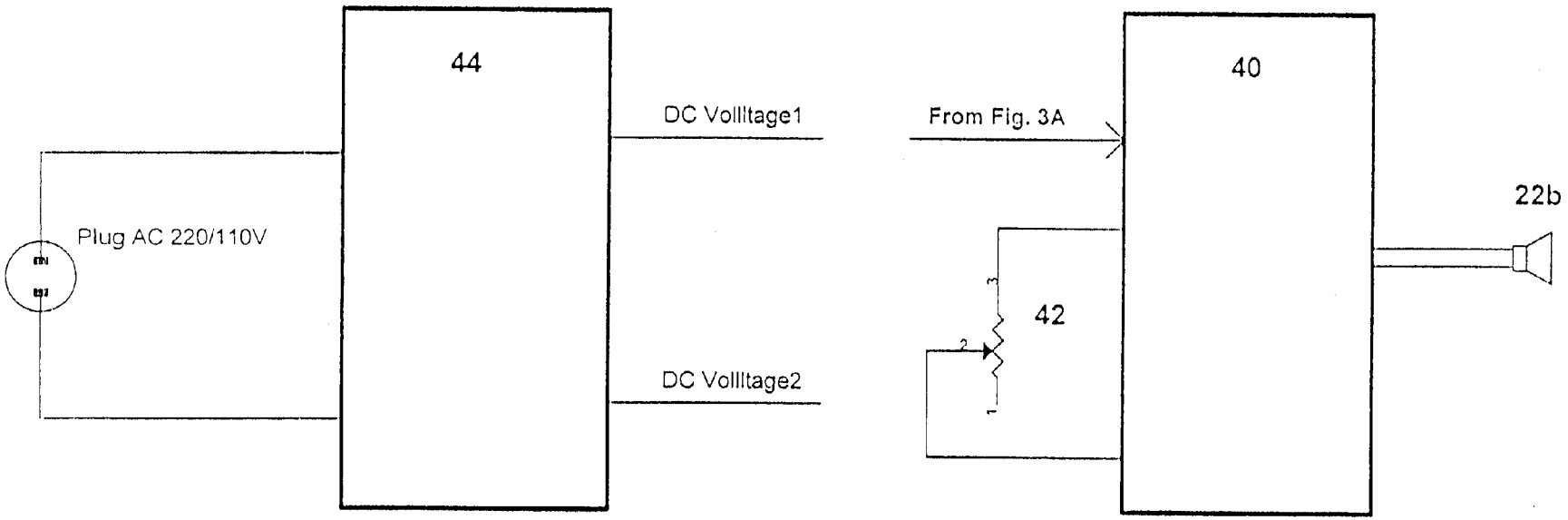

Turning now to tone generator system 22, this is typically, although not necessarily, subdivided physically into an electronics unit 22*a* and a loudspeaker 22*b*. The electronics unit 22*a* may be implemented either using analogue circuitry or by use of a digital computer. By way of a first non-limiting example, FIGS. 2, 3A and 3B show one possible analogue implementation.

Electronics unit 22*a* is here based upon one or more chip 30 which generates an oscillating signal having a frequency which varies as a function of the output voltage of sensor 20. An example of such a chip is well known as a "4046" chip which exists in a number of variants.

It should be noted that instrument 10 may be configured to operate in one or more of a number of modes. In a first preferred mode represented in FIG. 4A, tone generator system 22 varies the pitch of the output as a substantially continuous function of the sensor output. This results in a sliding pitch which varies in a smooth progression corresponding to variations in the breath pressure of the user. In a second preferred mode represented in FIG. 5, tone generator system 22 varies the pitch between a number of discrete values corresponding to a predefined scale. In this case, the user's breath pressure is always mapped to the nearest corresponding note of the scale. The scale itself may be any one predefined scale, or may be selectable from a plurality of predefined scales. Examples of suitable predefined scales include, but are not limited to, a major scale, a minor scale, a chromatic scale, a diminished scale and a pentatonic scale.

Figure 4A:
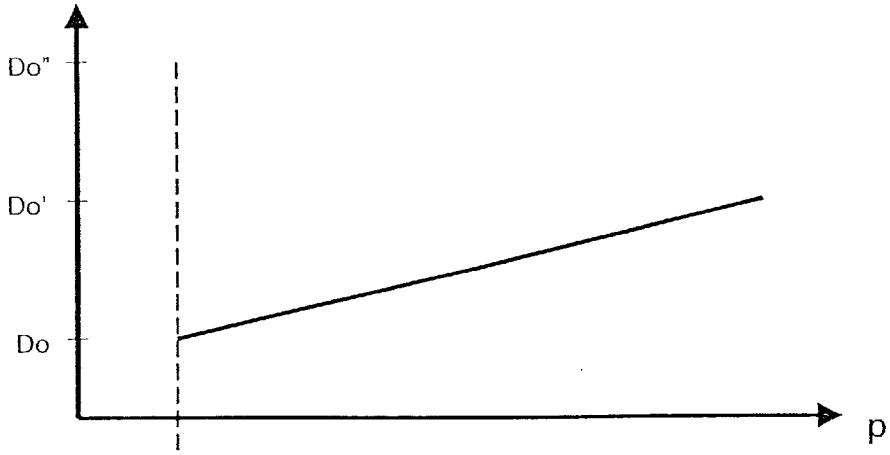
FIGS. 4A–4C are plots showing a first relation of pressure to frequency for a continuous-frequency-variation implementation according to various parameter settings.
Figure 4B:
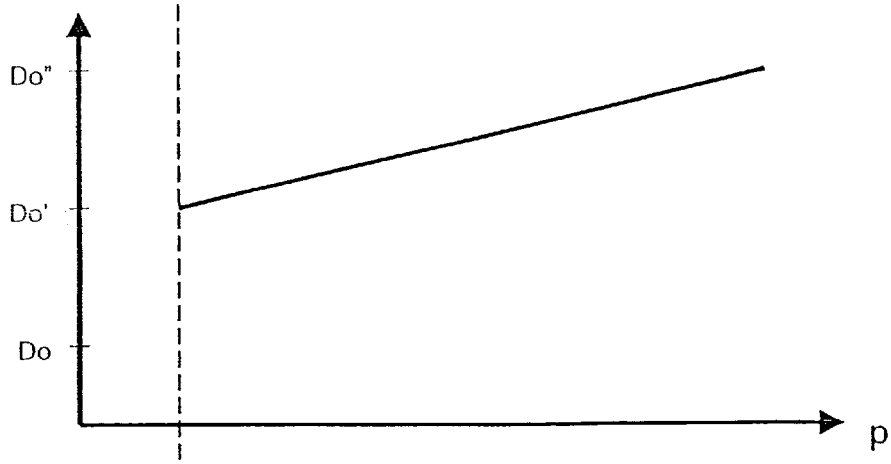
Figure 4C:
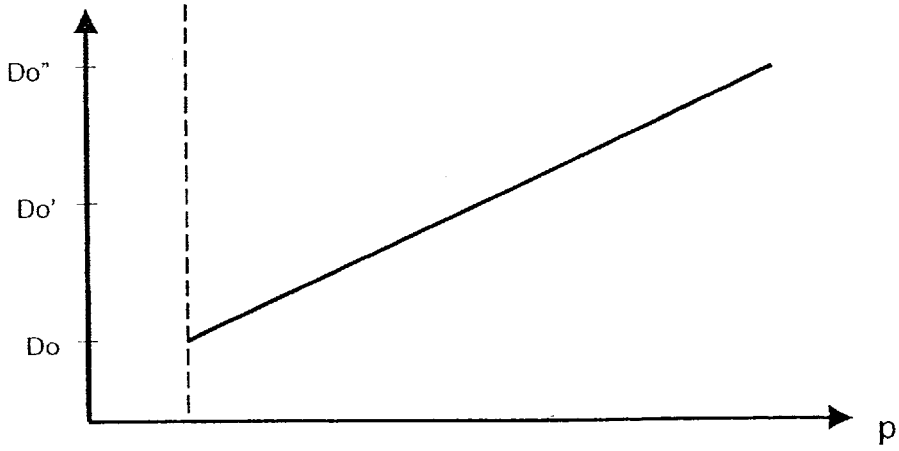
Figure 5:
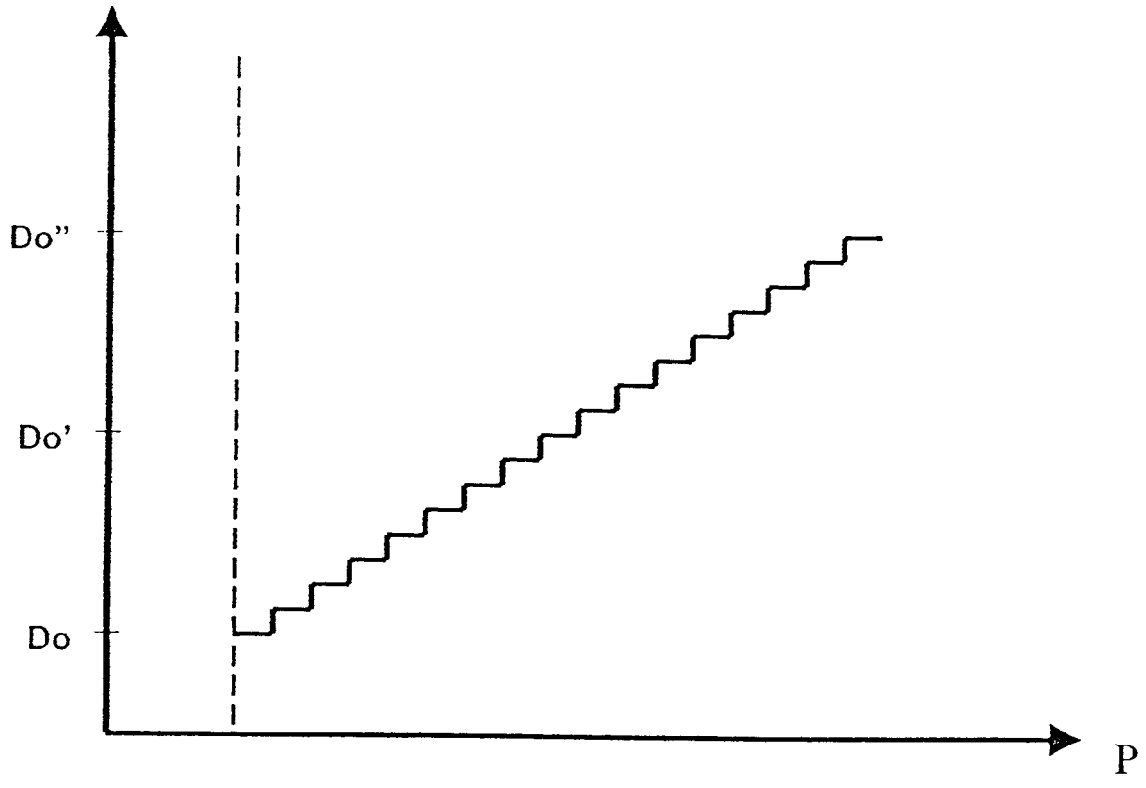
FIG. 5 is a plot showing an alternative relation of pressure to frequency for a discrete-scale implementation of the present invention.

Electronics unit 22*a* preferably includes a pitch shift control 32 operative to shift at least a lower limit of a range of frequencies within which the pitch varies, and a sensitivity adjustment control 34 operative to vary a breadth of a range of frequencies within which the pitch varies. Depending upon the implementation, controls 32 and 34 may be independent controls or, as in the electronic scheme of FIG. 3A, they may be combined into controls for the lower-pitch-limit 33 and the upper-pitch-limit 35. In either case, these controls preferably allow the user to set both the lower extreme of the pitch range which the instrument will produce at low pressures and the sensitivity, i.e., how much the pitch will vary for a given change in breath pressure. For example, the pitch shift control may allow the user to select a range starting from "middle-C" (or "Do" as seen in FIG. 4A), an octave higher (FIG. 4B) or an octave lower. The sensitivity control may allow the user to chose whether the response of instrument 10 to the normal range of breath pressures will span one octave (FIG. 4A), two octaves (FIG. 4C) or three octaves.

Electronics unit 22*a* also preferably includes threshold interrupt circuitry 36 (FIG. 3A) configured to interrupt generation of the audible tone when the output of sensor 20 falls below a predefined threshold value. This ensures that instrument 10 is silent whenever the user stops blowing. Also provided is an on/off switch 38.

Figure 6A:
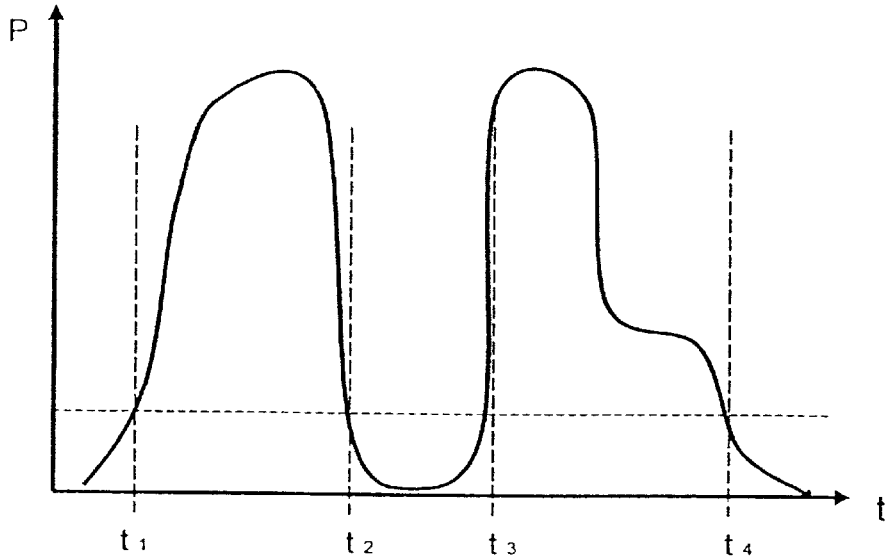
FIG. 6A is a sample plot of pressure variations measured by a pressure sensor of the musical instrument of FIG. 1.
Figure 6B:
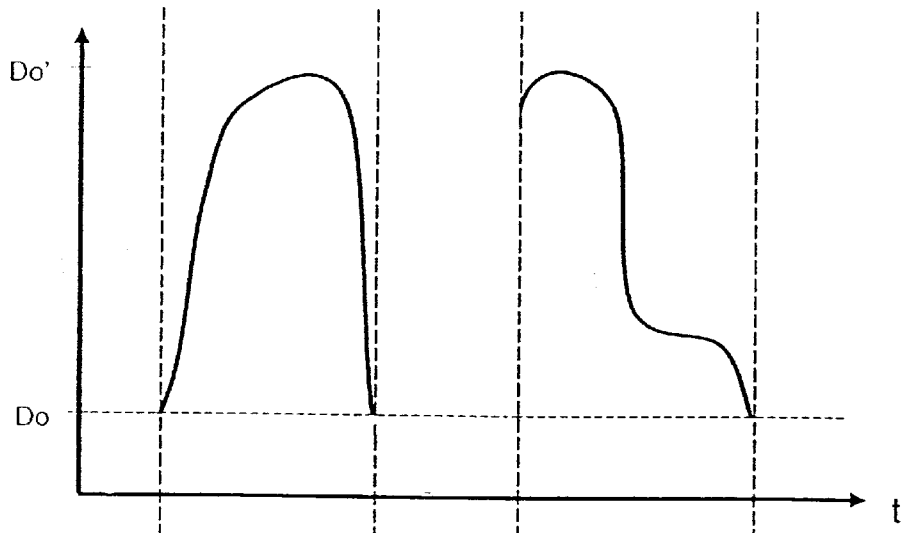
FIG. 6B is a plot of output pitch corresponding to the pressure variations of FIG. 6A according to the relation of FIG. 4A.
Figure 6C:
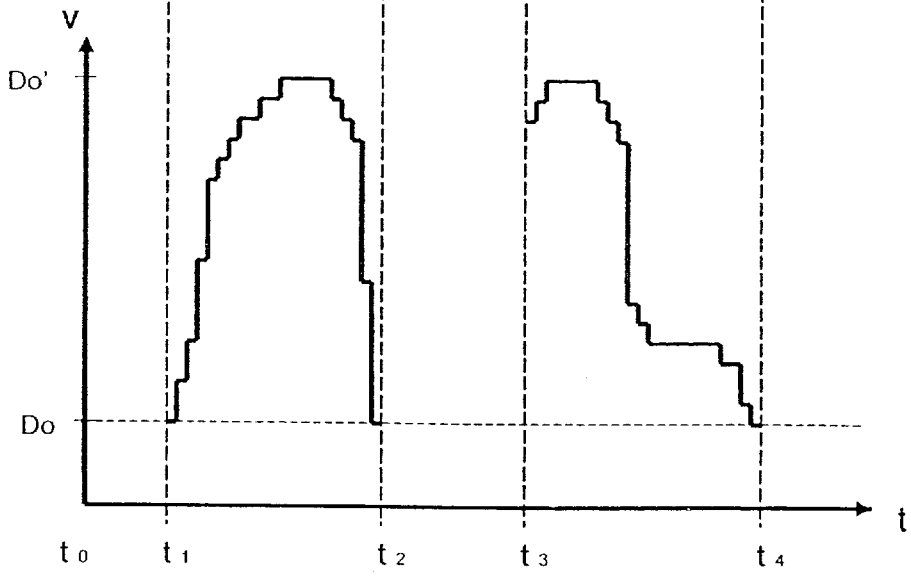
FIG. 6C is a plot of output pitch corresponding to the pressure variations of FIG. 6A according to the relation of FIG. 5.

An example of the combined effect of the threshold interrupt circuitry 36 and the mode selection is illustrated in FIGS. 6A–6C. FIG. 6A shows a sample output from sensor 20 for a given time period. FIG. 6B shows the corresponding tone generator frequency according to the mode of FIG. 4A while FIG. 6C shows the corresponding tone frequency according to the mode of FIG. 5. In both cases, since the sensor output is below the threshold level during the time periods from $t_0$ to $t_1$ and from $t_2$ to $t_3$, no tone is generated during those periods. During the other periods, the form of the pitch variation in FIG. 6B closely parallels the variations of the sensor output. The pitch variation in FIG. 6C is also similar, but takes a stepped form as it switches between the discrete steps of the predefined scale.

Turning now to FIG. 3B, the output of the circuitry of FIG. 3A is fed to an amplifier 40 which powers speaker 22*b* to produce the final tone output by instrument 10. Amplifier 40 includes a volume control 42 which varies the final volume of the audible tone to be produced. Also shown in FIG. 3B is a dual-output-voltage DC power supply 44 suitable for powering the various components of tone generator system 22. For clarity of presentation, the connections between power supply 44 and each of the components have been omitted. Amplifier 40 and power supply 44 are, in themselves, generally standard modules details of which will be well understood by one ordinarily skilled in the art without further description.

Optionally, a tone type selector (not shown), for selecting the type of tone produced, such as "trumpet", "clarinet" etc. may be added to the system as will be clear to one ordinarily skilled in the art.

At this stage, operation of musical wind instrument 10, and the corresponding method of the present invention for controlling a musical wind instrument, will be clearly understood. Specifically, the user blows into instrument 10 and sensor 20 measures a parameter, preferably pressure, which varies as a continuous function of how hard the user blows. This parameter is then converted by electronics unit 22*a* according to a predefined relation into a corresponding frequency and an audible tone having a pitch equal to the corresponding frequency is generated. Depending upon details of the implementation, the predefined relation may correspond to a substantially continuous variation of frequency as a function of the parameter. Alternatively, the predefined relation may be defined to generate exclusively a number of discrete values of frequency corresponding to a predefined scale. When the measured parameter falls below a predefined threshold value, tone generator system 22 preferably interrupts generation of the audible tone.

Figure 7:
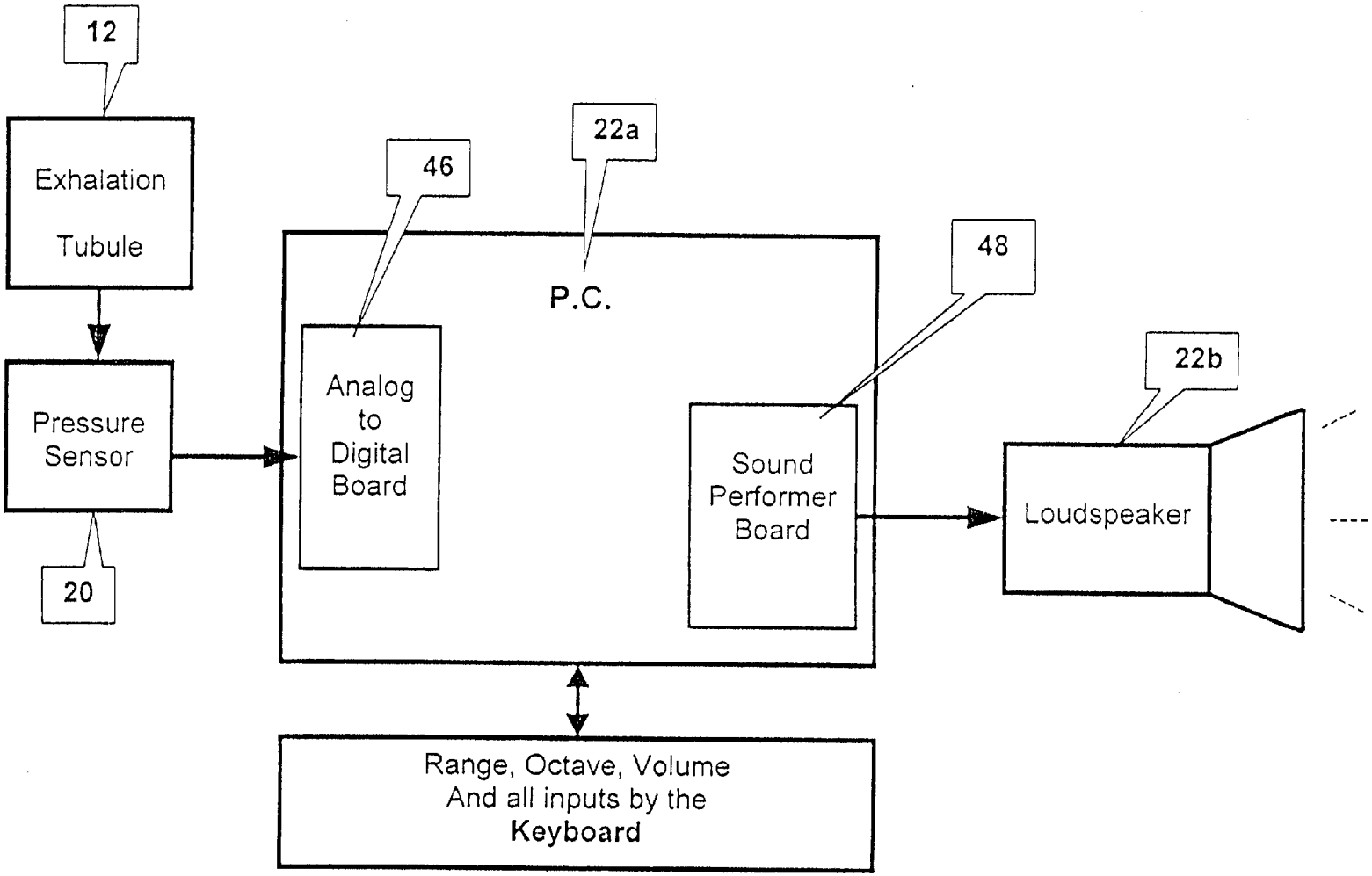
FIG. 7 is a schematic representation of a second implementation of the musical wind instrument of FIG. 1 employing a digital computer.

Turning now to FIG. 7, as mentioned earlier, instrument 10 may be implemented either using analogue circuitry or using a digital computer including a sound system 48. The digital computer option is represented schematically in FIG. 7. Here, electronics unit 22*a* may be implemented as a purpose-made stand-alone unit or, for reduced costs, may utilize hardware already present in a standard personal computer. To link an analogue pressure sensor 20 to the computer, an analogue-to-digital converter card 46 is typically added to the computer, or may be integrated with the body of instrument 10. In this case, all inputs, including pitch shift 32, sensitivity 34, on/off 38 and volume 42, are generally provided through one or more standard computer input device, such as a mouse, a keyboard and/or a foot pedal.

Parenthetically, it should be noted that a computer-based implementation has advantages in that multiple modes, such as for example the continuous pitch variation and discrete scale modes, may be provided by alternative software modules without requiring any change to the hardware. In all other respects, details of operation of the digital computer implementation of FIG. 7 are parallel to those described above with reference to FIGS. 2–6.

Figure 8:
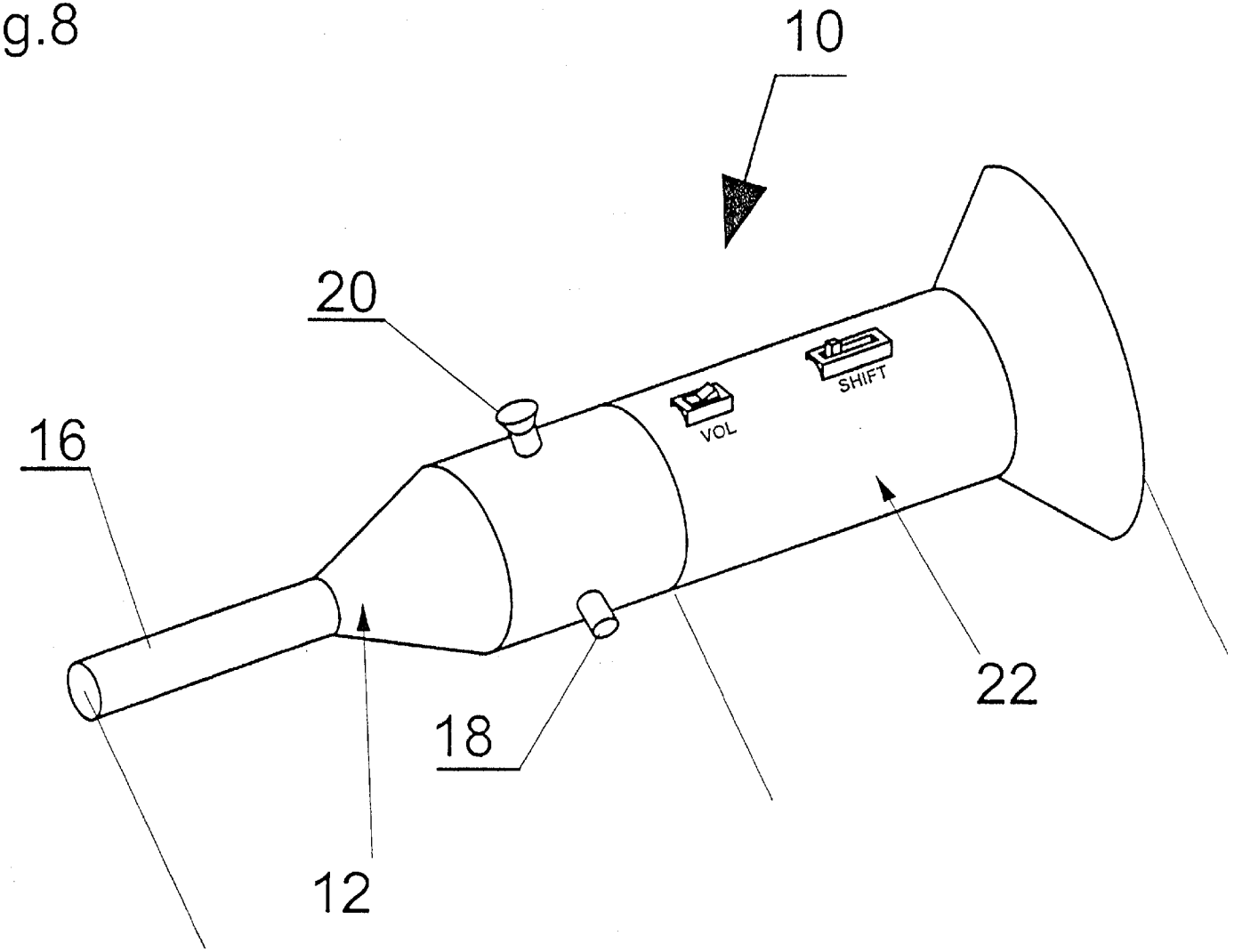
FIG. 8 is a schematic representation of the musical wind instrument of FIG. 1 implemented as a single self-contained unit.

Finally, turning briefly to FIG. 8, it should be appreciated that the various components of musical wind instrument 10 may be combined for convenience and aesthetic advantage into a single unit, for example, as an elongated instrument body as illustrated in FIG. 8. Details of all of the components remain as described above.

It will be appreciated that the above descriptions are intended only to serve as examples, and that many other embodiments are possible within the spirit and the scope of the present invention.

What is claimed is:

1. A musical wind instrument operable by a user to produce a sound, the instrument comprising:

(a) a mouthpiece through which the user blows air;

(b) a sensor associated with said mouthpiece and deployed to produce an output which varies as a function of how hard the user blows through said mouthpiece; and (c) a tone generator system electrically connected to said sensor and responsive to said output to generate an audible tone wherein a pitch of said audible tone varies as a function of said output, and hence as a function of how hard the user blows.

2. The instrument of claim 1, wherein said mouthpiece is associated with a housing which defines an internal volume such that the user blows through said mouthpiece into said internal volume.

3. The instrument of claim 2, wherein said housing further includes an outlet allowing restricted release of the air from said internal volume.

4. The instrument of claim 3, wherein said outlet is implemented as a manually adjustable valve, said valve being openable to a fully open position to facilitate draining of condensed moisture from said internal volume.

5. The instrument of claim 2, wherein said sensor is a pressure sensor deployed to produce an output which varies as a function of the air pressure within said internal volume.

6. The instrument of claim 5, wherein said pressure sensor is a differential pressure sensor deployed to produce an output which varies as a function of the air pressure within said internal volume relative to ambient pressure.

7. The instrument of claim 5, further comprising a flexible membrane deployed so as to prevent penetration of moisture from said internal volume to said pressure sensor.

8. The instrument of claim 1, wherein said sensor is an air flow sensor.

9. The instrument of claim 1, wherein said tone generator system varies said pitch as a substantially continuous function of said output.

10. The instrument of claim 1, wherein said tone generator system varies said pitch between a number of discrete values corresponding to a predefined scale.

11. The instrument of claim 1, wherein said tone generator system is configured to interrupt generation of said audible tone when said output falls below a predefined threshold value.

12. The instrument of claim 1, further comprising a volume control associated with said tone generator system and operative to vary a volume of said audible tone.

13. The instrument of claim 1, further comprising a pitch shift control associated with said tone generator system and operative to shift at least a lower limit of a range of frequencies within which said pitch varies.

14. The instrument of claim 1, further comprising a sensitivity adjustment control associated with said tone generator system and operative to vary a breadth of a range of frequencies within which said pitch varies.

15. The instrument of claim 1, wherein said tone generator system is implemented using analogue circuitry.

16. The instrument of claim 1, wherein said tone generator system is implemented using a digital computer including a sound system, said sensor being connected to said digital computer via an analogue-to-digital converter.

17. A method for controlling a musical wind instrument operated by blowing of a user, the method comprising:

(a) measuring a parameter which varies as a continuous function of how hard the user blows;

(b) converting the parameter according to a predefined relation into a corresponding frequency; and (c) generating an audible tone having a pitch equal to said corresponding frequency.

18. The method of claim 17, wherein said parameter is an air pressure within a volume into which the user blows.

19. The method of claim 17, wherein said parameter is a measure of air flow resulting from blowing of the user.

20. The method of claim 17, wherein said predefined relation corresponds to a substantially continuous variation of frequency as a function of said parameter.

21. The method of claim 17, wherein said predefined relation generates exclusively a number of discrete values of frequency corresponding to a predefined scale.

22. The method of claim 17, further comprising interrupting generation of said audible tone when said parameter falls below a predefined threshold value.

* * * * *